US006367900B1

(12) United States Patent
Woerner

(10) Patent No.: US 6,367,900 B1
(45) Date of Patent: Apr. 9, 2002

(54) MOUNTING BRACKET FOR THE SIDE RAILS OF REAR-MOUNTED DRAWER SLIDE ASSEMBLIES

(75) Inventor: Axel G. Woerner, Jamestown, NC (US)

(73) Assignee: Hafele America Co., Archdale, NC (US)

( * ) Notice: Subject to any disclaimer, the term of this patent is extended or adjusted under 35 U.S.C. 154(b) by 0 days.

(21) Appl. No.: 09/580,846

(22) Filed: May 30, 2000

(51) Int. Cl.[7] ..... A47B 88/00

(52) U.S. Cl. ..... 312/334.5; 312/334.1

(58) Field of Search ..... 312/334.4, 334.5, 312/334.7, 334.1, 330.1, 334.27; 248/220.21, 220.31, 220.41, 220.42, 220.43, 231.9, 225.11; 16/94 R

(56) References Cited

U.S. PATENT DOCUMENTS

| | | | | |
|---|---|---|---|---|
| 4,244,546 A | * | 1/1981 | Mertes et al. | 312/334.5 X |
| 4,795,116 A | | 1/1989 | Kobut et al. | 248/73 |
| 4,810,045 A | | 3/1989 | Lautenschlager | 312/330.1 |
| 5,039,181 A | | 8/1991 | Lautenschlager | |
| 5,257,861 A | | 11/1993 | Domenig et al. | 312/334.5 |
| 5,349,723 A | | 9/1994 | Domenig | 16/94 R |
| 5,359,752 A | | 11/1994 | Domenig | 16/94 R |
| 5,387,033 A | | 2/1995 | Domenig | 312/334.5 |
| 5,549,376 A | | 8/1996 | Domenig | 312/334.5 |
| 5,562,333 A | | 10/1996 | Domenig et al. | 312/348.1 |
| 5,597,220 A | | 1/1997 | Domenig et al. | 312/334.4 |
| 5,636,820 A | | 6/1997 | Domenig | 248/220.21 |
| 5,746,490 A | | 5/1998 | Domenig | 312/334.5 |
| 5,823,648 A | | 10/1998 | Domenig | 312/334.5 |

* cited by examiner

*Primary Examiner*—James O. Hansen
(74) *Attorney, Agent, or Firm*—Womble Carlyle Sandridge & Rice, PLLC; C. Robert Rhodes

(57) ABSTRACT

A mounting bracket for the side rails of rear-mounted drawer slide assemblies, including a base, spaced apart side walls, and substantially rigid L-shaped retainers attached to each side wall. The L-shaped retainers each have a horizontal portion and a vertical portion, where the vertical portion terminates with a gripping edge that is spaced from the front surface of the bracket base for frictionally receiving and laterally adjusting a side rail tongue portion.

8 Claims, 3 Drawing Sheets

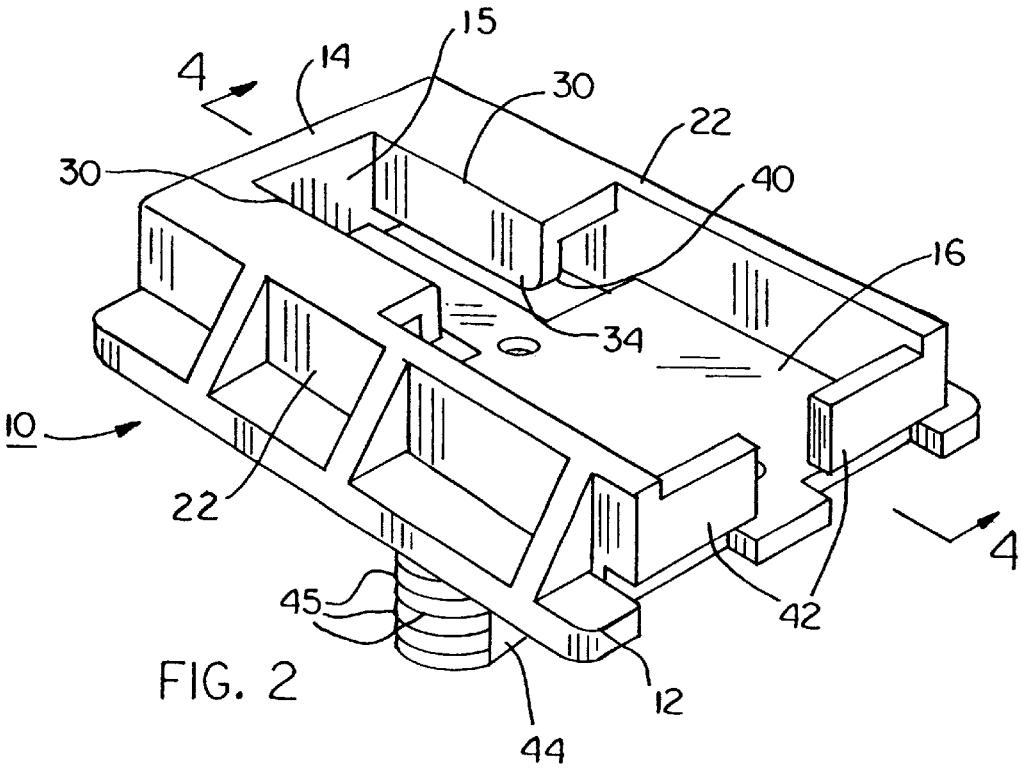
FIG. 2
FIG. 3
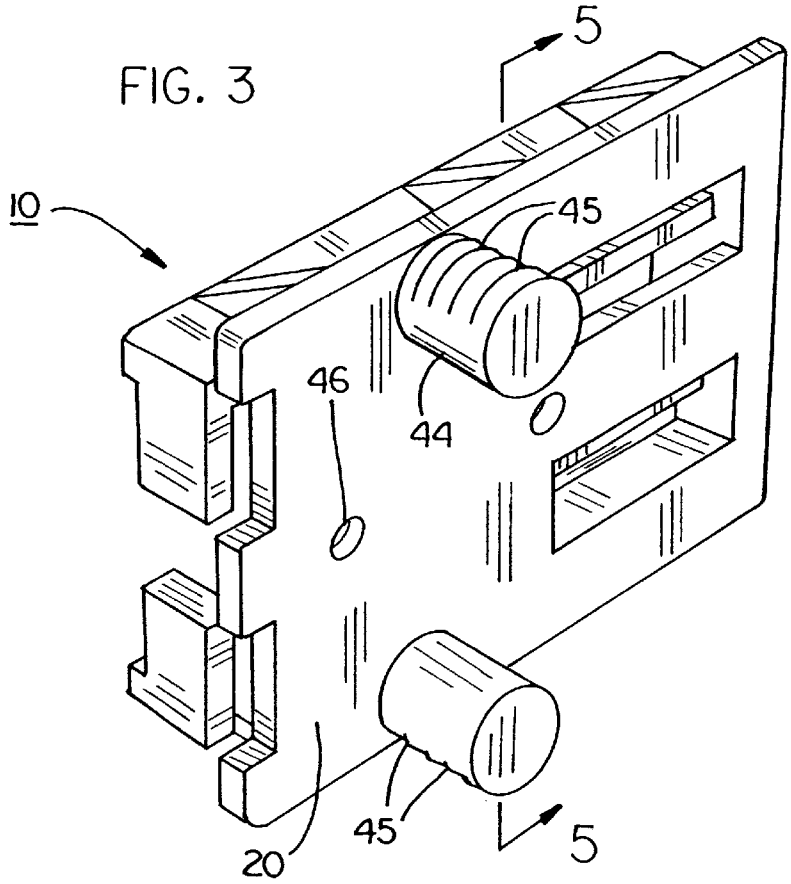

MOUNTING BRACKET FOR THE SIDE RAILS OF REAR-MOUNTED DRAWER SLIDE ASSEMBLIES

FIELD OF THE INVENTION

The present invention relates generally to mounting brackets for drawer slide assemblies, and particularly, to a bracket for the side rail of a rear-mounted drawer slide assembly that provides superior gripping force, yet permits lateral adjustments in the side rail position to be easily made without tools or movement of the bracket.

BACKGROUND OF THE INVENTION

Various types of mounting hardware have been used by manufacturers and assemblers for securing drawers within cabinets or other pieces of furniture. With side-mounted configurations, the drawer guide portion of the drawer mounting hardware may be mounted directly to the drawer cabinet side walls. However, for cabinet designs such as those used in kitchen cabinets, including peninsula cabinets and islands, the cabinets are formed with face frame members intended to house multiple drawers in an enclosed space wider than the individual drawers. Accordingly, for such purposes, hardware has been developed to mount drawer slide hardware between the face frame on the front and rear walls of the cabinet. These are referred to as "rear-mounted drawer slides".

With inaccuracies inherent in the manufacturing of furniture and because other factors, such as environmental conditions and variations in material properties, can affect the dimensions of cabinets and drawers, particularly those constructed of wood, there has arisen a need for mounting hardware that is adjustable, particularly laterally. In response to this need, hardware has been developed with adjusting features formed directly on the mounting bracket; e.g., slides, latches, and screws. However, these are often difficult to adjust and wear or loosen quickly during the service life of the furniture. These problems have given rise to inexpensive rear mounting brackets that accept side rails having inwardly oriented tongue portions at the rear thereof.

There are known in the art several forms of laterally adjustable rear mounting brackets formed from lightweight plastic materials. One such bracket includes a base with opposing spring flanges that accept a tongue portion and allow the tongue portion to slide between the spring flanges and the base of the bracket. Brackets of this type, while simple and inexpensive, do not provide adequate gripping force to prevent drawer slide shift and movement with repetitive opening and closing of the drawers, unless supplemented with other fasteners that extend through the tongue and bracket base portion. As a consequence of their relatively lightweight and spring-type constructions, these brackets are also more subject to material fatigue and breakage from normal use.

SUMMARY OF THE INVENTION

The present invention is directed to a simple, inexpensively produced rear mounting bracket permitting lateral adjustment of the side rail of rear-mounted drawer slides having tongue portions. A further object of the present invention is to provide a mounting bracket of unitary construction having substantially rigid retaining members with gripping edges capable of exerting an increased holding force on the tongue portions of side rails, while remaining lightweight and durable.

Accordingly, one aspect of the present invention is to provide a mounting bracket permitting lateral adjustment of a side rail, that includes a base, opposed side walls, and L-shaped retainers. The bracket is formed from a durable ABS plastic; however, other suitable materials of similar strength and durability may be substituted. The base has a generally flat front surface. Opposed, spaced apart side walls of equal length are also integrally formed and extend outwardly from the flat front surface, with each side wall extending substantially the length of the base. An L-shaped retainer is integrally attached to each side wall, making it substantially rigid and inflexible. Each retainer has a portion extending from the front edge of each side wall parallel to and spaced from the front surface and a horizontal portion extending toward the base. The horizontal portion terminates in a gripping edge. The thickness of the vertical portion is sufficient for added rigidity and strength. The space between the gripping edge and the front surface of the base is about the same as the thickness of the tongue of the side rail such that the tongue will be frictionally received and engaged by the gripping edge.

Another aspect of the present invention includes an end wall formed at one end of the bracket and at least one edge stop on the opposite end, each integrally formed with and attached to at least one of the side walls. Preferably, each retainer is further integrally attached to and molded with the end wall, enhancing its rigidity and strength and adding to its inflexibility. The edge stop assists in the installer in defining the limits of lateral adjustment without adversely affecting proper opening and closing of the drawer. Because the drawer slide tongue is longer than the space between the receiving edge of the retainer and the edge stop, the receiving edge of the horizontal portion is desirably chamfered at the entrance to the gap so that the tongue can be cantilevered into position and frictionally received by the gripping edge.

The spacing between the gripping edge and front surface, in combination with the effective length of the gripping edge, ensures that a sufficient gripping force is applied to the guide tongue, preventing unwanted lateral movement of the tongue, yet permitting lateral adjustments to be made with relative ease and without the need for tools of movement of the bracket itself . This construction provides 50 to 88 percent more gripping force than spring-type flanges used in other lightweight plastic brackets. This corresponds to a holding force of 12 to 15 pounds per square inch on the drawer guide tongue.

For attaching the mounting bracket to a drawer cabinet rear wall, the present invention desirably includes two or more dowels attached to and extending outward from the mounting bracket base bottom surface. Each dowel has one or more radially outwardly extending projections with tapered edges pointing inward toward the base rear surface. Accordingly, the dowels may be easily inserted into slots formed for receiving them, but will resist removal. At least one opening may also be formed in the base for inserting additional fasteners into the cabinet wall. This provides not only additional holding force for the mounting bracket against the wall, but if also inserted through the tongue portion of the drawer guide, may provide an even greater holding force needed for much heavier duty constructions. This eliminates the need for larger, bulkier mounting brackets.

These and other aspects of the present invention will become apparent to those skilled in the art after reading the following description of the preferred embodiment when considered with the drawings.

BRIEF DESCRIPTION OF THE DRAWINGS

FIG. 2 is front perspective view of the mounting bracket;

FIG. 3 a rear perspective view of the mounting bracket;

DESCRIPTION OF THE PREFERRED EMBODIMENTS

Figure 1:
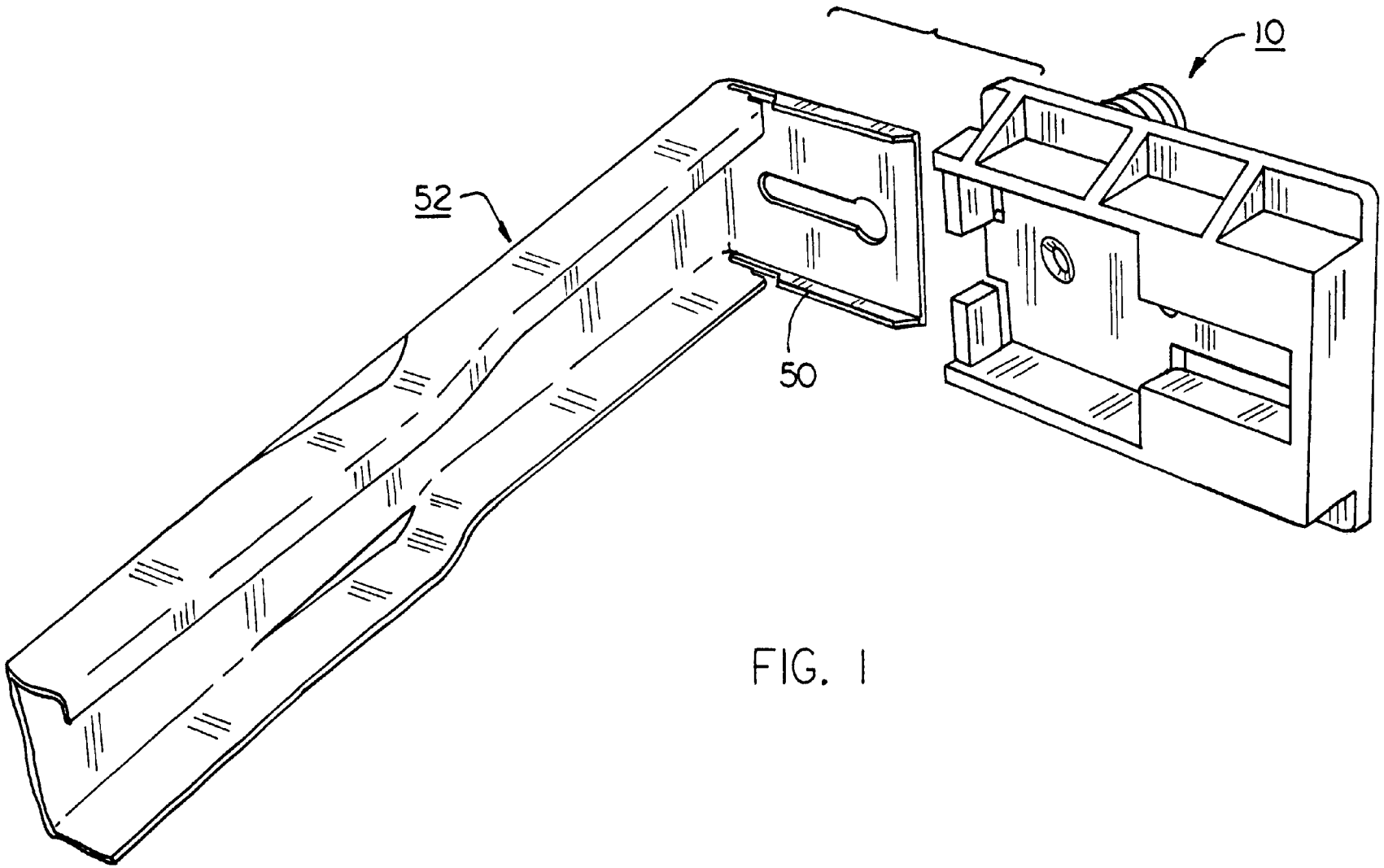
FIG. 1 is a partial environmental view of a mounting bracket for receiving and laterally adjusted a drawer guide according to the present invention.

Referring now to the drawings in general and FIG. 1 in particular, it will be understood that the illustrations are for the purpose of describing a preferred embodiment of the invention and are not intended to limit the invention thereto. Side rail 52 is conventional for a rear-mounted configuration and includes a tongue 50 bent at approximately a 90 degree angle from the rear end of the side rail 52. As best seen in FIGS. 2 and 3, a mounting bracket, generally designated 10, includes a base 12, an end wall 14, opposed side walls 22, and L-shaped retainers 30. Mounting bracket 10 is formed from a durable ABS plastic, but other suitable materials of similar strength and durability may be substituted.

In the preferred embodiment, base 12 has a generally flat front surface 16 and generally flat rear surface 20. Front surface 16 faces inward toward the front of the cabinet, while rear surface 20 is mounted adjacent the surface of the cabinet rear wall. Integrally formed with base 12 is an end wall 14 extending outwardly from front surface 16. Opposed, spaced apart side walls 22 are also integrally formed with and extend substantially the entire length of base 12. An L-shaped retainer 30 is attached to each side wall 22, and preferably to end wall 14. The L-shaped geometry of retainer 30, in combination with its attachment to side wall 22 and end wall 14, enhance the strength and durability of retainer 30 while making it substantially rigid and inflexible. This construction provides 50 to 88 percent more gripping force than spring-type flanges used in other lightweight plastic brackets and corresponds to a holding force of 12 to 15 pounds per square inch on tongue 50 of side rail 52.

Figure 4:
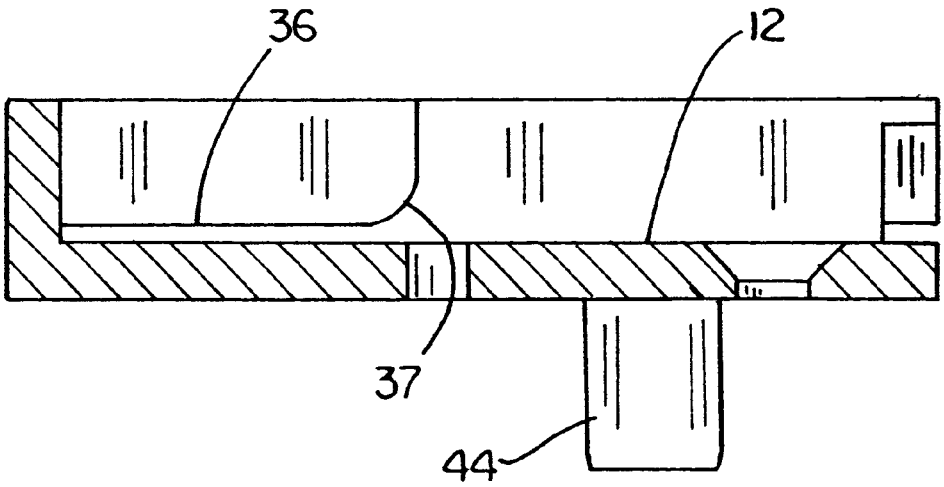
FIG. 4 is a sectional view of the mounting bracket along Line 4—4.
Figure 5:
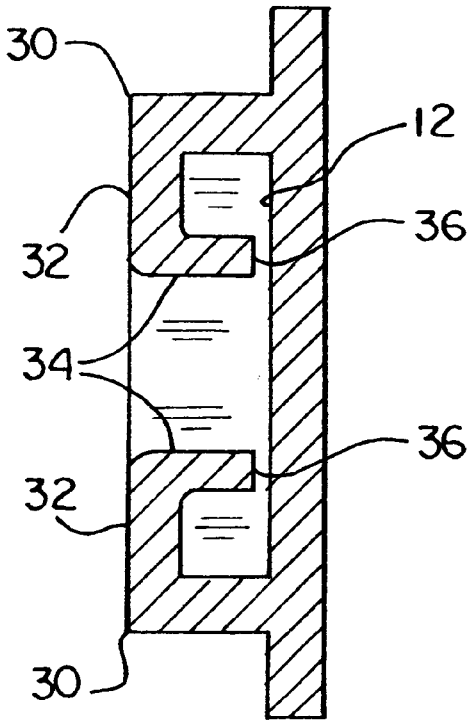
FIG. 5 is a sectional view of the mounting bracket along Line 5—5.

Each L-shaped retainer 30 has a vertical portion 32 that is parallel to front surface 16 and a horizontal portion 34 that extends toward the front surface 16, wherein horizontal portion 34 terminates at the free end in a substantially flat gripping edge 36. The vertical portion 32 and horizontal portion 34 are of sufficient thickness that the retainer 30 is substantially rigid. As best seen in FIGS. 4 and 5, an effective clearance gap is formed between the gripping edge 36 and front surface 16 for receiving tongue 50. Because the space formed between gripping edge 36 and base 12 is no greater than and about the same thickness as tongue 50 of guide rail 52, the tongue will be frictionally received and engaged by gripping edge 36. As a result, the side rail 52 is held in position during repeated usage and does not slip.

In the preferred embodiment, mounting bracket 10 also includes at least one integrally formed stop 42 attached to side walls 22 at the end opposite end wall 14 for limiting the degree of lateral adjustment and preventing inadvertent withdrawal of the tongue 50 from the mounting bracket 10. As seen in FIGS. 2 and 4, because the space between the ends 31 of retainers 30 and rear stops 42 is less than the length of a side rail tongue 50, gripping edge 36 has a chamfered leading end 40 for frictionally receiving tongue 50.

As best seen in FIGS. 3 and 4, mounting bracket 10 is attached to a drawer cabinet rear wall with a pair of integrally formed dowels 44, extending rearward from the rear surface 20. Each dowel 44 has a plurality of radially outwardly extending projections 45 having tapered edges formed on at least a portion of the circumference of dowel 44 and pointing inward toward rear surface 20. The dowel 44 and projection 45 combination permits easy insertion of dowels 44 into openings formed in the cabinet rear wall, but resists removal. An opening 46 is formed through base 12 for the insertion of additional fasteners, if desired, through base 12 and into the cabinet wall.

Certain modifications and improvements will occur to those skilled in the art upon a reading of the foregoing description. It should be understood that all such modifications and improvements have been deleted herein for the sake of conciseness and readability, but are properly within the scope of the following claims.

I claim:

1. A mounting bracket for receiving and laterally adjusting a side rail of a drawer slide assembly, the side rail including a rear tongue with a front surface, the mounting bracket comprising:

(a) a base, said base having a front surface;

(b) opposed spaced apart side walls extending outwardly from said front surface; and (c) a substantially rigid L-shaped retainer attached to each of said side walls, each said L-shaped retainer having a vertical portion parallel to the front surface and a horizontal portion extending toward the front surface and terminating in a gripping edge so spaced from the front surface as to frictionally receive and grip against the front surface of the rear tongue of said side rail for lateral adjustment.

2. The mounting bracket of claim 1 further including an end wall wherein said L-shaped retainer is attached to said end wall.

3. The mounting bracket of claim 1 wherein said gripping edge is capable of applying a holding force of 12 to 15 pounds per square inch on said rear tongue.

4. The mounting bracket of claim 1 wherein said gripping edge has a receiving end, said receiving end being chamfered for receiving said side rail tongue.

5. The mounting bracket of claim 1 wherein the vertical portion of said L-shaped retainer is thicker than the horizontal portion of said retainer.

6. The mounting bracket of claim 1, further including at least one edge stop attached to at least one of said side walls.

7. The mounting bracket of claim 1 wherein said base includes a rear surface and two or more dowel portions attached to and extending rearward from said rear surface, each said dowel portion having one or more projections with tapered edges, said projections extending radially outward from said dowel and inward toward said rear surface.

8. The mounting bracket of claim 1, further including at least one opening formed through said base for receiving fasteners.

* * * * *